US011809144B2

(12) United States Patent
Overhoff

(10) Patent No.: US 11,809,144 B2
(45) Date of Patent: Nov. 7, 2023

(54) TIMER FOR MONITORING LAPSE OF TIME RELATIVE TO A TOTAL AMOUNT OF ALLOWED TIME

(71) Applicant: YKO Systems B.V., Roosendaal (NL)

(72) Inventor: Renatus Wilhelmus Seraphinus Overhoff, Roosendaal (NL)

(73) Assignee: YKO Systems B.V., Roosendaal (NL)

( * ) Notice: Subject to any disclaimer, the term of this patent is extended or adjusted under 35 U.S.C. 154(b) by 555 days.

(21) Appl. No.: 16/979,896

(22) PCT Filed: Mar. 14, 2019

(86) PCT No.: PCT/EP2019/056471
§ 371 (c)(1),
(2) Date: Sep. 11, 2020

(87) PCT Pub. No.: WO2019/175340
PCT Pub. Date: Sep. 19, 2019

(65) Prior Publication Data

US 2020/0409314 A1 Dec. 31, 2020

(30) Foreign Application Priority Data

Mar. 14, 2018 (NL) ..... 2020587

(51) Int. Cl.
*G04G 9/04* (2006.01)
*G04C 3/00* (2006.01)

(52) U.S. Cl.
CPC ..... *G04G 9/047* (2013.01); *G04C 3/002* (2013.01)

(58) Field of Classification Search
CPC ..... G04F 1/00; G04F 1/005; G04G 9/047; G04C 3/002
See application file for complete search history.

(56) References Cited

U.S. PATENT DOCUMENTS 5,044,961 A * 9/1991 Bruskewitz ..... G09B 19/12 368/45
5,253,228 A * 10/1993 Truett ..... G04F 1/005 368/239

(Continued)

FOREIGN PATENT DOCUMENTS

CN 203844510 U 9/2014
CN 205229692 U 5/2016

(Continued)

*Primary Examiner* — Edwin A. Leon
*Assistant Examiner* — Jason M Collins
(74) *Attorney, Agent, or Firm* — N.V. Nederlandsch Octrooibureau

(57) ABSTRACT

A timer to monitor lapse of time relative to a total amount of allowed time includes: a body and a foot on or of the body, a sensor; a processor connected to the sensor and configured to monitor a lapse of time; and an output device connected to the processor. The processor is configured to control the output device to generate a signal at least indicating the monitored, lapsed time relative to the total amount of allowed time. The sensor is configured to indicate whether the timer rests on the foot; and the processor is configured to monitor the lapse of time, during which it is indicated by the sensor that the timer rests on the foot, and stop or pause to monitor the lapse of time, when the timer rests not or not only on the foot. The processor is configured to control the output device.

20 Claims, 4 Drawing Sheets

(56) References Cited

U.S. PATENT DOCUMENTS

| | | | | |
|---|---|---|---|---|
| 5,684,758 | A * | 11/1997 | Gray | G04F 1/00 368/45 |
| 7,426,157 | B2 * | 9/2008 | Arnold | G04G 15/00 368/111 |
| 7,978,566 | B1 * | 7/2011 | Russo | G04G 11/00 368/241 |
| 9,547,281 | B2 * | 1/2017 | Rubin | G04F 1/00 |
| 10,303,123 | B1 * | 5/2019 | Rogers | G04B 45/0092 |
| 2006/0133215 | A1 * | 6/2006 | Gordon | G04G 15/006 368/79 |
| 2014/0039946 | A1 * | 2/2014 | Spiker | G04F 1/005 705/5 |

FOREIGN PATENT DOCUMENTS

| | | | |
|---|---|---|---|
| DE | 20307738 | U1 | 9/2003 |
| EP | 2056174 | A1 | 5/2009 |

* cited by examiner

TIMER FOR MONITORING LAPSE OF TIME RELATIVE TO A TOTAL AMOUNT OF ALLOWED TIME

The present disclosure relates to a timer to monitor lapse of time relative to a total amount of allowed time. All sorts of restrictive timers are known in the art, to forcibly stop children from gaming or being online for too long. For instance gaming or internet devices may have parental control programs or apps, which discontinue use thereof, upon reaching a maximum online or gaming period, which may be set up in the parental control program or app. Such parental control programs or apps need to be simultaneously executed or running on the gaming or internet device, with the internet or gaming program being enjoyed by the device's user(s).

This restrictive approach is considered to be little educational or even counterproductive, in the perception of the inventors of the present disclosure, and frustrating to children, and moreover also a continuous source of discussion when children question the objectivity of such parental control programs or tampering with the set periods. After all, gaming and internet access are enjoyed by children a lot, and abrupt discontinuation of gaming or internet services more often than not, as parents may confirm, result in such discussions with children, who can manifest themselves in a somewhat unreasonable manner, resulting from the abrupt termination of the services, especially very near the end of a movie or game or game level, and the like.

The inventors of the present disclosure have realized that educational value of parental control programs and apps is low, and that restrictive parental control does not appeal to children's own sense of responsibility and consequently results in discussions and even anger out of frustration.

For the sake of completeness, reference is made here to DE 203 07 738 U1, EP 2 056 174, CN 203 844 510 U and CN 205 229 692 U, which are all acknowledged here as prior art.

The utility model disclosed in DE 203 07 738 U1 comprises a digital hourglass with time controlled lights, where the deactivated lights in the upper set correspond to the activated lights in the lower set. The device is intended for use in a sauna bath. It counts up or down for the fixed and predetermined duration of a single treatment, where the counting up or down is started by a switch or touch sensor or inclinometer, operated by the bath guest, to count down from or up to a reset value of the maximum time duration to be spent in the sauna bath. Operation of the switch, touch sensor or inclinometer results in an instantaneous reset of the timer to the predetermined maximum time for a bath guest to spend in the sauna bath.

The publication EP 2 056 174 discloses a mobile terminal device, time control method and timer control program capable of displaying corresponding images and performing a time measurement accordingly when a user moves the mobile terminal device as if to operate an hourglass. The timer control program controls the time measurement based on measured data from an acceleration sensor. This device is specifically intended to perform a single time measurement that starts as well as resets and restarts when the device is turned upside down and returned to its original position.

The utility model of CN 203 844 510 U disclosed an embodiment of an electronic hourglass that comprises a color-changing LED display module with the LEDs arranged in an hourglass shape. Based on its three-axis acceleration sensor, the device can automatically change the flow direction of the simulated sand particles and enters a sleep state automatically, interrupting the time-keeping function. The microprocessor of the device is connected to a wireless communication module so that timed data can be saved and viewed on an intelligent terminal.

The utility model of CN 205 229 692 U discloses an embodiment of an electronic hourglass, specifically intended to overcome the limitations of a traditional physical hourglass. The device comprises an electronic screen instead of physical sand, thereby reducing the volume and being more convenient to carry around, and has a flexible timing mode convenient for use and saving resources.

None of the devices disclosed in the above publications are suitable for use in the context of the present invention as these are only capable of counting down for a predetermined duration, can be reset by anyone within reach of the device and cannot be paused to resume count up or down of the timing once the activity is recommenced. Furthermore, in all of the above identified disclosures, lapse of time is monitored relative to a single continuous time period. There is no accumulation of time over multiple periods so that a total amount of lapsed time can be compared to a total amount of allowed time. Additionally, time is counted as soon as the timer is started, without a condition that determines whether timing is appropriate to the activity being undertaken. Moreover, any person in reach of the above devices can tamper with the settings of the device, restart timing or turn over the digital hourglass to revert the counting of time.

To alleviate the above identified and other problems, drawbacks and disadvantages of the prior art, the present disclosure proposes a novel timer, comprising features of the appended independent timer claim.

The timer of the present disclosure may be a stand alone device, not implemented on the gaming or internet access devices, and puts responsibility for activities, such as gaming and internet access, with for instance children who play games and access the internet. The children are compelled, based on for example reached agreement about the amount of time spent on the activities with parents, to place the timer in a position to start or continue monitoring lapse of time, when they start such activities. When a total amount of allowed time of access to such activities has lapsed, the activities such as games and internet access are not abruptly disconnected, but the timer may give an indication that the set total amount of allowed time has lapsed, to allow children to finish a game level, watching a movie or the like. Content with having completed what they were doing, they may inactivate the devices and flip the timer device to a pause or stop position, not on the foot, but on a side or at least not only on said foot. Only once a calendar unit of time has expired, a fresh ration of a new total amount of allowed time is made available by the timer. This is in stark contrast with the digital hour glass of DE 203 07 738 UI, which allows a reset for making available a new/fresh total amount of allowed time available upon input by the user. The calendar unit of time may be any one of an hour, morning, afternoon, evening, entire day or night, week, month or year. Reset of the total amount of allowed time or the allowance of a new total amount of allowed time, is provided to the user, only when the calendar unit of time has expired. This enables the device to signal both expiry of the total amount of allowed time, as well as when a fresh amount of allowed time has become available, after expiry of the calendar unit of time. In addition to or as an alternative for the maximum duration of activities like gaming and/or internet access, the total amount of allowed time may be defined in terms of a minimum period that no same or similar activities may be performed after lapse of a time of gaming and/or internet access. Only when the period of not performing the same or similar activities has lapsed, will the timer again be set in a position corresponding with such or similar activities and indicate that such activities are again allowed. Also, the total amount of allowed time may be defined in terms of a pause period. These and other aspects can be programmable settings to be set by a parent or an authorized user.

In any case, when a child is on a gaming device or internet access device, when the timer indicates that this is no longer or not yet agreed, parents can see this and inquire into reasons, allow further the activities, or appeal on the children's own sense of responsibility. To this end the stand alone nature of the timer is of importance, so parents don't have to demand to see the gaming or internet access device, or any similar device, to determine that agreed rules are bent or broken, which is indicated by the stand alone timer according to the present disclosure.

The above provides an indication of the minimum requirements of the present disclosure in accordance with the appended independent claim. However, the present disclosure relates also to non-limiting preferred embodiments, which are disclosed below in relation to embodiment description of preferred embodiments in the appended drawings, and/or defined in appended dependent claims.

The timer's body may be octagonal in cross section. This allows easy manipulation of the timer.

The timer's body may have an hourglass shape in frontal view. This resembles a recognizable shape, easily associated with the function thereof, which is to keep time, just like an hourglass.

The timer may be such, that the total amount of allowed time may be defined in terms of at least one of the following concepts from a group, comprising: a maximum activity period of time for doing activities of a same nature; a minimum interval period of time after lapse of the maximum activity period of time to restart doing activities of a same nature; a minimum pause period within a maximum activity period of time to restart doing activities of a same nature. The period referred to above may therefore be the maximum for one (type of) activity, a minimum time during which the same or a similar activity may not be done, or a period during which the same or a similar activity is interrupted or suspended and the timer should be paused. Other meanings may be attributed to the expression of the feature of the total amount of allowed time. The timer's output device may comprise an auditory generator, such as a buzzer or a speaker, to generate a sound signal, such a buzzing sound, a tone, a melody, or even a pre-recorded spoken message relating to the monitored lapse of time or the total amount of allowed time.

The timer's output device may comprise a visual display. In such an embodiment, the visual display may comprise an array of a plurality of light sources, each indicating a proportional part of the set total amount of allowed time, wherein the processor is configured to sequentially extinguish or light up light sources in the array depending on monitored lapse of time. Then, the visual display may comprise a plurality of arrays each comprising light sources having a distinct color per array. The colors may indicate that gaming or internet access or any other activity is allowed, again allowed, no longer allowed, paused, or the like, and if segmented in proportional parts, for how long in the past or into the future.

The timer may comprise a display screen connected to the processor, wherein the processor is configured to show, on the display screen, at least one information from a group, comprising: the monitored lapse of time, the total amount of allowed time, remaining battery charge, and the adapted time for storing in the memory. Other information is naturally also possible to be shown, within the scope of the present disclosure. In such an embodiment, the processor may be configured to, depending on an orientation of the timer, adapt orientation in which the information is shown on the display screen, for the information to be presented upright to a person.

The timer may comprise a memory connected to the processor to store the total amount of allowed time, which may be fixed or may be adjustable for changing by an authorized person. In such an embodiment the memory may be programmable, and the processor may be configured to adapt the total amount of allowed time and store an adapted total amount of allowed time in the memory.

The timer may further comprise a wired or wireless communication interface for communications with an external device, such as a computer, a lap top, or a mobile device. The wireless communication interface may include radio wireless communication such as local area networking and personal area networking, including wifi and Bluetooth technologies, as well as mobile communication networking, including 5G technologies. This enables communication of the device with an app running on another person's device, such as a parent's mobile phone, providing instantaneous information about activities in which a child is involved. Such an app may also be useful for entering parameters of the program executed by the device, such as any of the times or period defined in the appended claims, and referred to in the present embodiment description.

Further, interesting information may be gathered, and via this communication link also stored in a server and/or cloud environment, such as periods or times during which a specific user is involved in particular activity, for example for parents to be able to review reports of their child's activity data, such as time spent on internet browsing or gaming, which usage information may be presented in the form of statistics and/or graphs. To this end a parent may have one or more than one account at a service, to enable parents to review the user specific usage information of their child or children's gaming or internet browsing or U-tube watching behavior. Similarly more general information may be gathered from sets of specific information, such as the time allowed in general by parents in different countries to their children, for parents' reference when coming to agreements with their children about game or internet behavior and more in particular time spent on such activities as gaming and internet browsing.

In an embodiment with a programmable memory and a communication interface, the timer's processor may further be configured to receive the user adapted total amount of allowed time from the external device for storage thereof in the memory, after initial setting or adaptation thereof by a user via a user interface or app being executed on the external device.

The timer's processor may be configured to transmit the total amount of allowed time stored in the memory to the external device, upon detection by the communication interface of the establishment of a connection with the external device.

The timer's exterior surface, and preferably the entire timer, may be free of input buttons, switches and the like. This would reduce a risk of tampering.

The timer of the present disclosure may be such, that the processor is configured to control the output device to generate a signal indicating that monitored lapsing time, during which the timer rests on the foot, equals or exceeds the total amount of allowed time. Additionally or alternatively, the timer may signal that a new total amount of allowed time has become available, after expiry of a lapsed calendar unit of time, such as a day, week, month, or year.

Following the above indication of the core and preferred aspects of the present disclosure in terms of the appended claims, below an embodiment description is provided of preferred embodiment(s) with reference to the appended drawing of non-limiting preferred embodiment(s). None of the features of the appended drawing and/or the following embodiment description is limiting on the scope of protection of the present disclosure, which is exclusively to be determined in accordance with the appended independent claims, while even including, in some jurisdictions, equivalent features. In the appended drawing:

Figure 1:
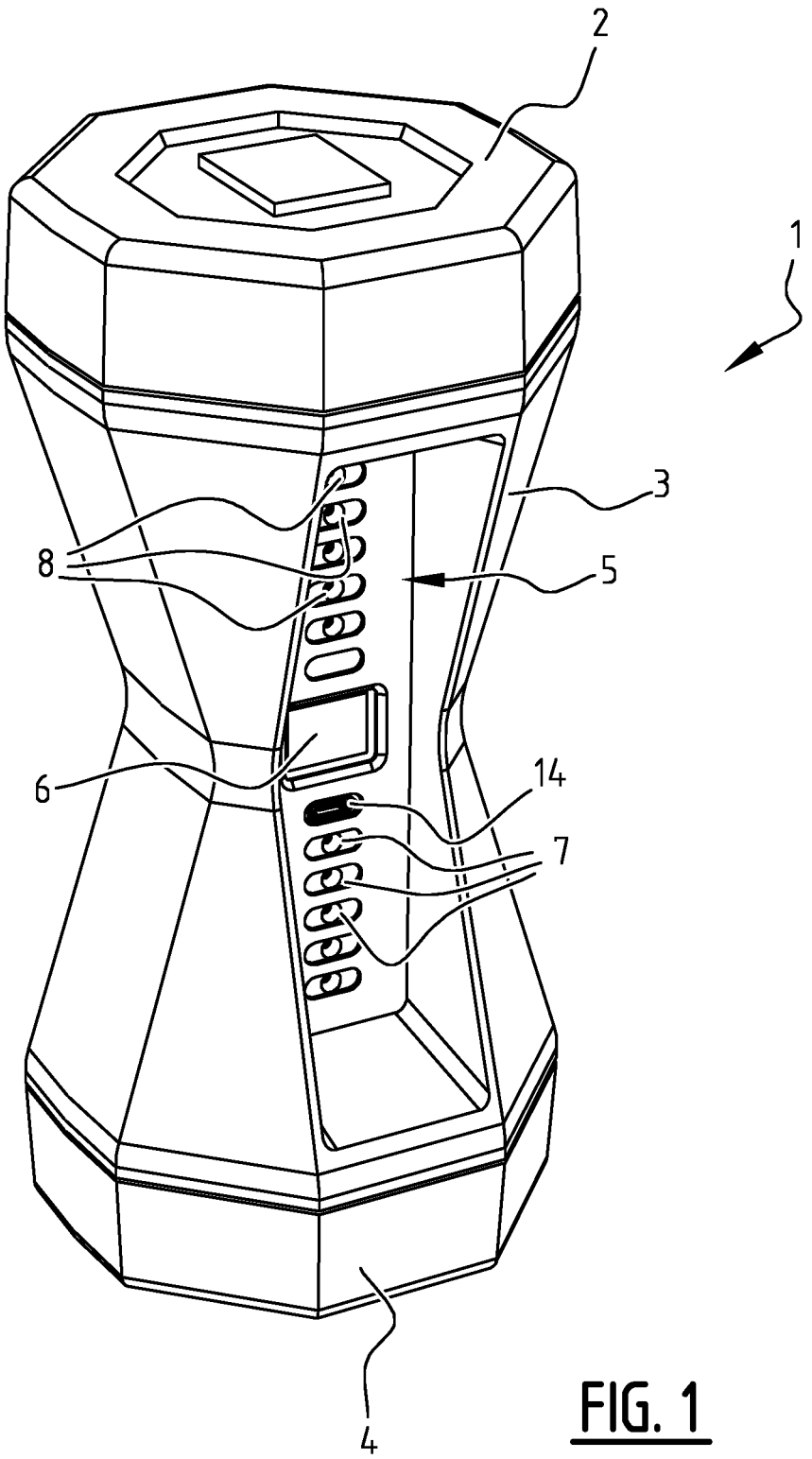
FIGS. 1, 2 and 3 show perspective views of a timer according to the present disclosure in different positions.
Figure 2:
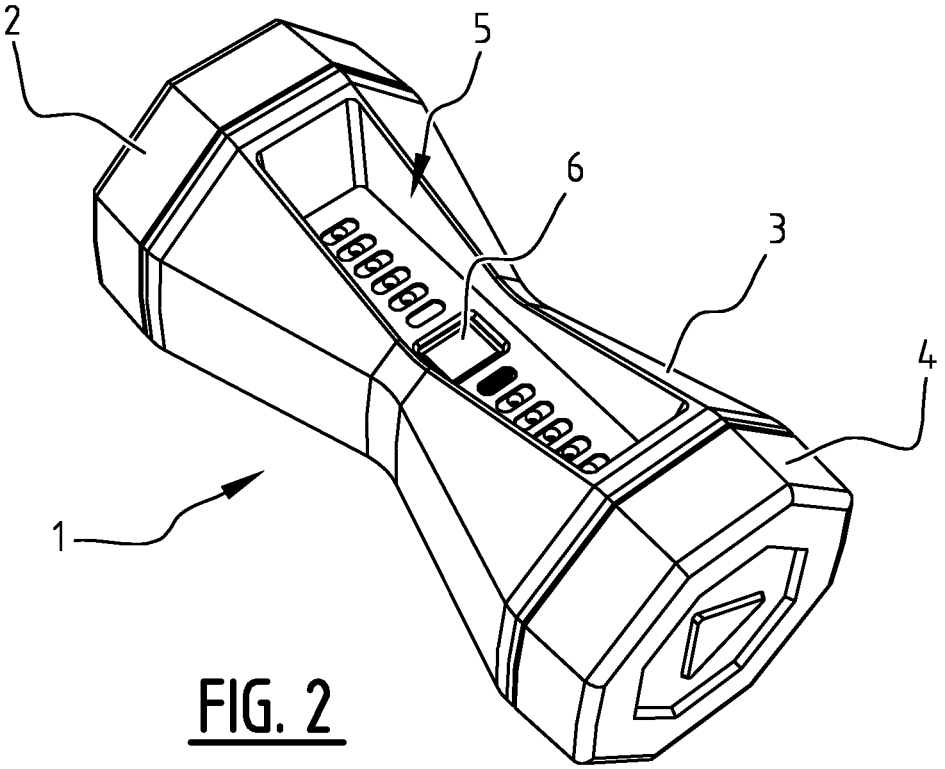
Figure 3:
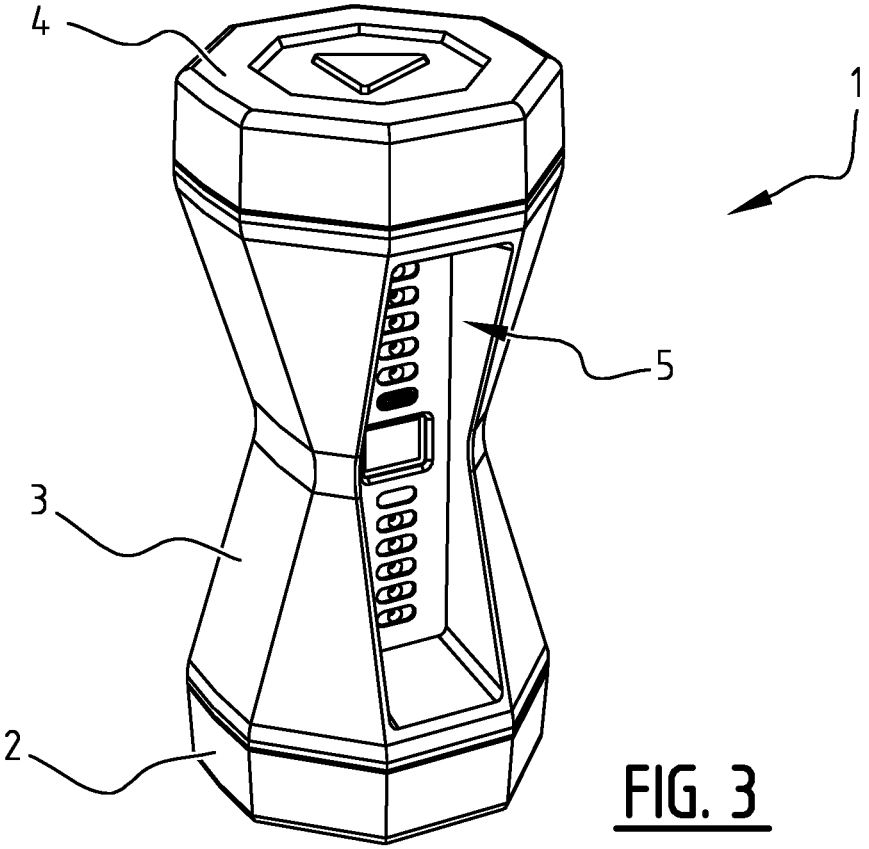

FIGS. 1-3 show a timer 1 in an embodiment according to the present disclosure, to monitor lapse of time relative to a total amount of allowed time. The timer 1 comprises two feet 2, 4, on which the timer can stand. A body 3 extends between the feet 2, 4. The body 3 is octagonal in cross section, and has an hourglass shape in frontal view. Body 3 may be made from plastic, for example a soft touch material and/or be compressible to some extent. The material may be based on polyurethane or the like, and/or form a shock absorber.

Any one or more than one of the feet 2, 4 may be embodied to form closing a cap, which may be removable to enable access to the interior of the body 3. Feet 2, 4 may alternatively be fixedly attached to body 3.

Body 3 comprises a recess 5, in which a number of output devices is arranged, wherein the output device may comprise any one or more than one of a display screen 6, an array of green lights 7, for example LED's, and an array of red lights 8, for example LED's, or any other suitable output device, including buzzers, speakers 13 and the like. The output devices may alternatively be arranged on the exterior of body 3, omitting recess 5.

Figure 4:
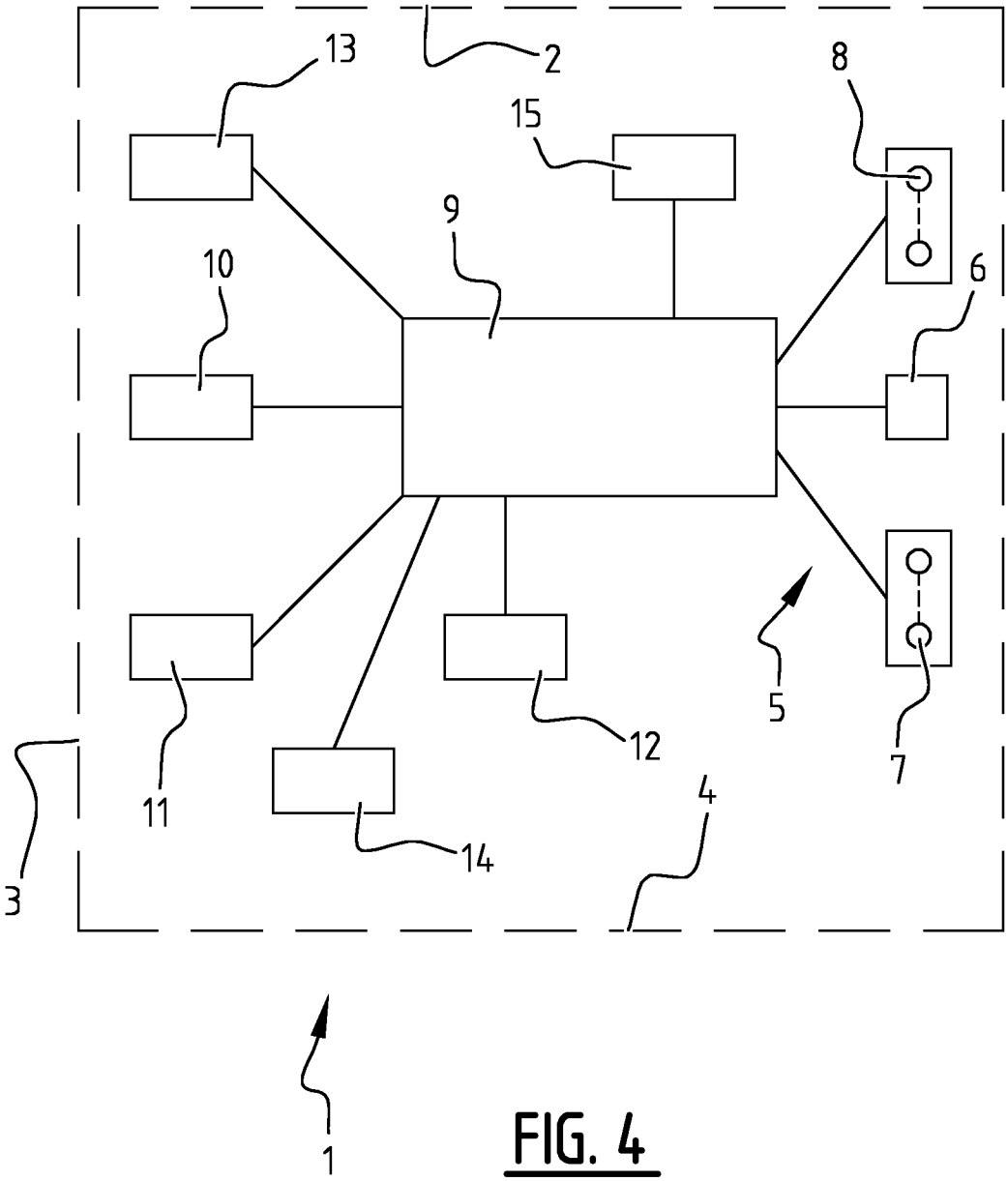
FIG. 4 shows a schematic representation of an embodiment of a timer according to the present disclosure.

FIG. 4 shows a schematic representation of an embodiment of a timer according to the present disclosure. It is not necessarily the same embodiment as that of FIGS. 1, 2 and 3, but where applicable the same or similar reference signs are used in the following embodiment description of FIG. 4, as in FIGS. 1, 2 and 3.

Timer 1 comprises sensor 11 configured to determine whether timer 1 rests on one of its feet 2, 4. Sensor 11 may be in the form of an accelerometer, an orientation sensor, a GPS module, a gravity sensor, or any alternative and/or additional device. Sensor 11 is connected to a processor 9, and timer 1 is optionally powered using a battery 10, powering at least processor 9. Processor 9 is connected to sensor 11 and configured to monitor lapse of time relative to a pre-set total amount of allowed time for allowing the activities, during which sensor 11 determines that timer 1 rests on one or more than one of the feet 2, 4. To this end a clock circuit 15 may be provided, and such a clock circuit may well be incorporated into the processor 9.

The processor monitors time during which timer 1 rests on one of the feet 2, 4. When timer 1 is no longer standing on that particular one of feet 2, 4, processor 9 stops or pauses monitoring lapse of time relative to the total amount of allowed time. When the person who is engaged in the activities flips timer 1 from the position in FIG. 3 to the position in FIG. 1, countdown of the total amount of allowed time for the activity is stopped. The timer may begin counting down a mandatory pause period between activities. When timer 1 is put on its side, as in FIG. 2, timer 1 pauses counting down of the total amount of allowed time, to resume counting down when timer 1 is flipped to the position of FIG. 3, or to stop when timer 1 is flipped to the position of FIG. 1.

Processor 9 is further connected to a memory 12 for storage of at least one of the total amount of allowed time, a remainder of the total amount of allowed time, a time since pausing deduction of time from the total amount of allowed time, a time since ending a previous period of activities, and the like, as well as a program under control of which timer 1 functions.

For adapting a program, programmable settings, and the like, an authorized user may gain access to timer 1 via a connection 14, such as a USB connector, provided in recess 5 with the output devices 6, 7 and 8. A wireless connection is also possible within the scope of the present disclosure. Through connection 14, the program and/or the total amount of allowed time and its constituent periods may be adapted as desired, preferably in accordance with an agreement reached beforehand with the person to be engaged in the activities according to time constraints or limitation.

In addition to, or as an alternative for the output devices of the LED arrays 7, 8 and display 6, processor 9 may be connected to a buzzer or speaker 13.

For example, foot 2 may be red and foot 4 may be green. When red foot 2 is pointed up, this flags that no activities with time constraint or limitation are being performed, and the processor 9 may stop or pause monitoring lapse of time. This is to say that processor stops deducting time from a pre-set total amount of time allowed for the activities, but may continue to monitor lapse of time to determine that sufficient time has lapsed to again allow a new period of activities or that a pause period within the allowed period has ended, depending on programmable settings of the timer, in accordance with a program stored in a memory 12, along with the total amount of allowed time for allowing the activities. When the timer is placed with the red foot 2 on a support surface by a person who is going to be involved in activities with a time constraint or limitation, preferably agreed beforehand, the green foot 4 will point upwards, indicating that the person is involved in the activities. This orientation is detected by sensor 11, which notifies the processor 9, which will start deducting time starting from the pre-set total amount of allowed time, possibly starting from a remainder of the total amount of allowed time after a pause period, which may also be stored in memory 12. When the total amount of allowed time is spent, and the monitored lapse of time exceeds the length of the total amount of allowed time, processor 9 may cause buzzer or speaker to generate an instantaneous, continuous or intermittent auditory signal, such as a buzzing sound, or spoken words to notify the person involved in the activities that the total amount of allowed time is over. Additionally or alternatively, buzzing or other sounds may be used to indicate that the end of the activity time is approaching.

From a distance, a parent can hear this and/or see that the green foot 4 is up, while the processor may further cause the red lights 8 to illuminate. The parent or other authorized person may then point out the discrepancy (green foot 4 up with red light 8 on), and appeal to the sense of own responsibility of the person involved in the activities to stop or pause activities and set timer 1 with the red foot up.

During the activities, the processor may perform a sort of count down. While the total amount of allowed time is being spent, a number of green lights 7 may be on, with said number in proportion with the remainder of the total amount of allowed time.

After ending the activities, for reaching the end of the total amount of allowed time or to start an intermediate pause, the red lights 8 may count down to when activities may be resumed.

Additionally or alternatively, display 6 may show, under control of processor 9, the set total amount of allowed time, monitored lapse of time, a remainder of the amount of allowed time for the activity period, a remainder of a stop or pause period, remaining battery charge, etcetera. Also, during programming of timer 1 with an external device connected to processor 9 via connection 14, the program, programmable settings, total amount of allowed time and/or remainder of a total amount of allowed time may be adapted in memory 12, where display screen 6 may show made changes.

Display screen 6 may be controlled by processor 9 to, depending on an orientation of the timer, adapt orientation in which the information is shown on and relative to display screen 6, for the information to be presented upright to a person In such an embodiment with display screen 6, a single red light 8 and a single green light may suffice. In an embodiment with singular red and green lights, red foot 2 may be translucent and may be illuminated red from within timer 1 to indicate that activities should be stopped or paused, while illumination of the green foot 4 may indicate that at a particular time, the activities are allowed. An advantage of such an embodiment is visibility of the indications of feet 2, 4 from all around timer 1.

In this manner processor 9 is configured to control any one or more than one of the above described output devices 2, 4, 6, 7, 8 and/or 13 to generate a visual or sound signal indicating that monitored lapse of time, during which the timer rests on red foot 2 with green foot 4 upwards, equals or exceeds the total amount of allowed time.

The total amount of time may be defined in terms of at least one of a maximum activity period of time for doing activities of a same nature; a minimum interval period of time after lapse of the maximum activity period of time to restart doing activities of a same nature; a minimum pause period within a maximum activity period of time to restart doing activities of a same nature. The processor may be configured, for example through the program in memory 12, to communicate with external gaming and/or internet devices, for example through the wired but preferably wireless connection 14. The enables registration of transgressions of the total amount of allowed time and seriousness thereof, which may be stored to memory 12 for later review by an authorized user. Activity devices for gaming, internet access and the like may even be made to cooperate with the timer of the present disclosure and shut down or pause at termination of a period, or only after occurrence of an excessive transgression.

Processor 9 may be configured to receive the user adapted total amount of allowed time or program settings, and the like, from the external device for storage thereof in the memory, after initial setting or adaptation thereof by a user via a user interface or app being executed on the external device.

Prior to any adaptations of an amount of time or program setting, processor 9 may be configured to retrieve and transmit a most recent value of the total amount of time from memory 12 to the external device, upon detection by connection 14 of the establishment of a connection with the external device.

Programmable settings in or of timer 1 may be game time, day time, week time, month time, wait time, interrupt time, etcetera, all indicating periods of time of different sorts to be monitored. A game time setting is for a maximum period of time of being continuously engaged in the activity. A day time setting may indicate a maximum amount of time spent on activities per day. This may include one or more than one period of game time. The day time setting may apply to any given day and/or may even be variably set for different days of the week (for example schooldays versus weekend days) or of a month. A week or month time setting may indicate a maximum amount of time spent on activities per week or month and may vary per week/month (for example school weeks versus holidays). This may include one or more than one period of game time. A wait time setting may indicate a pause between game times of being continuously engaged in the activities. An interrupt time setting may indicate a minimum period of time of suspending activities during a game time. A week, month or year may be programmed, even on a daily basis.

Figure 5A:
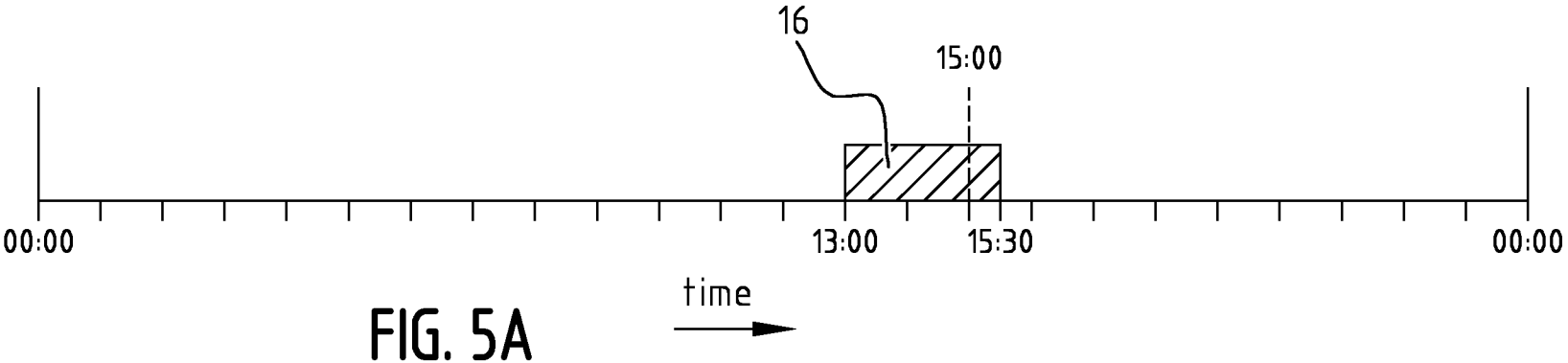
FIG. 5A shows a calendar unit of time in which the timer is placed on the foot for a single continuous period.
Figure 5B:
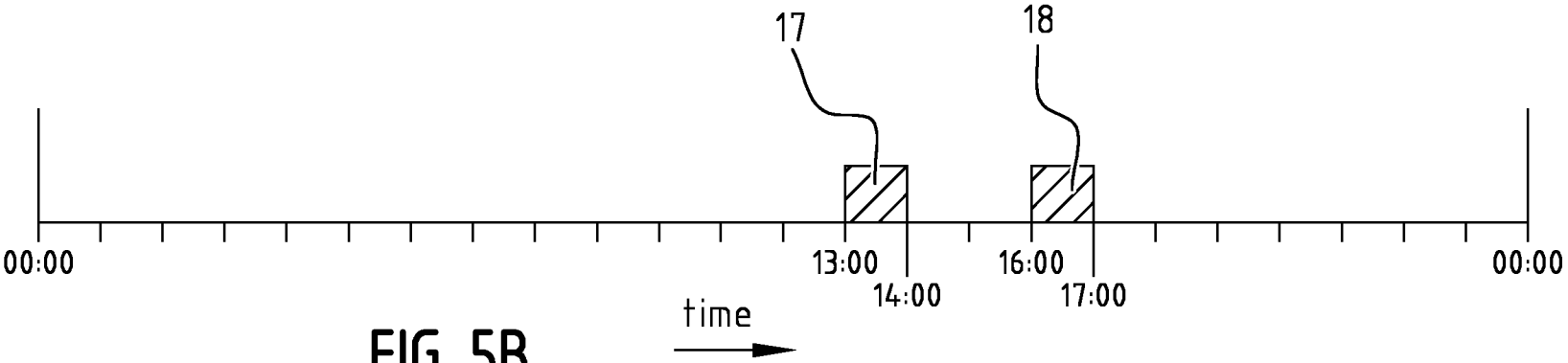
FIG. 5B shows a calendar unit of time in which the timer is placed on the foot for two separate periods of time.

FIGS. 5A and 5B serve to further clarify some of the above features by showing an exemplary calendar unit of time and periods in which the timer 1 is placed on the foot 2. In these two unrestrictive examples, the calendar unit of time is programmed to be a day starting at 00:00 on that day and lasting up to 00:00 on the next day and the timer is placed on the foot 2 to indicate that the user is engaged in an activity for which a time restriction has been agreed. The start time and end times of the calendar period may be arbitrarily chosen, for example from 8 AM on one day to 8 AM the following day. Also, the begin and end times do not necessarily span a calendar day, and may for example encompass from 8 AM to 8 PM of one calendar day, with the remainder being indicated as blocked for the activity, or conversely indicate unrestricted activity. In FIG. 5A, the timer 1 is placed on the foot 2 for a single continuous period 16 from 13:00 to 15:30, to indicate that the user is engaged in an activity during this period of time. The settings may be programmed such, that the activity is allowed during this period of time and that the total amount of allowed time for the activity is 2 hours per day. In the example of FIG. 5A, the effect of such settings may be that the timer 1 starts indicating that the activity is no longer allowed from 15:00 onwards as the total amount of allowed time has been used at that point. The timer 1 now indicates violation of previously agreed time restrictions. At 15:30, the timer 1 is placed not or not only on the foot 2 and the timer 1 may cease to indicate that the activity is no longer allowed. It may maintain an indication that a violation has taken place. At 00:00 of the next day, or any other programmed setting that delimits one day from the next, the timer 1 may indicate that the activity is again allowed.

In FIG. 5B, the timer 1 is placed on the foot 2 in two separate periods of time: a first period 17 from 13:00 to 14:00 and a second period 18 from 16:00 to 17:00, to indicate that the user is engaged in an activity during two periods of time with a pause in between. The settings may be programmed such, that the total amount of allowed time for the activity is 2 hours per day with a minimum pause period of 2 hours between activity periods. In the example of FIG. 5B, the effect of such settings may be that the timer adds the duration of the second period 18 to the first period 17 to monitor the lapse of time, during which the timer 1 rests on the foot 2, relative to the total amount of allowed time per day. At the end of the first period 17 at 14:00, the timer is placed not or not only on the foot. It may now indicate that the activity is not allowed for another 2 hours. At 16:00, after lapse of the minimum pause period, the time 1 may indicate that the activity is again allowed. The user may now place the timer 1 on the foot 2 and the timer 1 may then indicate agreement with the time restrictions. The timer 1 may further indicate a gradual reduction in the remaining total amount of allowed time so that the user may end the activities at 17:00, in compliance with the previously agreed time restrictions, and then place the timer 1 not or not only on the foot 2. The timer 1 may now start to indicate that the activity is no longer allowed. At 00:00, or any other programmed setting that delimits one day from the next, the timer may indicate that the activity is again allowed.

In the described embodiments, at least the exterior surface of timer 1 is free of input buttons, switches and the like. However, any timer within the scope of protection of the present disclosure may have operating or setting buttons, switches and the like on the external surface. The device may be programmed or programmable to exhibit a travel mode, in which functionality thereof may be suspended.

Above, embodiments of the present disclosure are revealed. However, the present disclosure is in no way to be interpreted as limited to any specific feature of any embodiment, unless the scope of protection according to the appended independent claim so requires, and even then the protection may include—at least in some jurisdictions—obvious alternatives for features in the claims.

The invention claimed is:

1. A timer to monitor a lapse of time relative to a total amount of allowed time, comprising:

a body and a foot on or of the body, wherein the apparatus can rest on at least the foot;

a sensor;

a processor connected to the sensor and configured to monitor the lapse of time; and an output device connected to the processor, wherein the processor is configured to control the output device to generate a signal at least indicating the monitored, lapsed time relative to the total amount of allowed time;

wherein the sensor is configured to indicate whether the timer rests on the foot; and the processor is configured to monitor the lapse of time, during which it is indicated by the sensor that the timer rests on the foot, and stop or pause to monitor the lapse of time, when the timer rests not or not only on the foot; and the processor is configured to control the output device to generate a signal at least indicating the monitored, lapsed time, during which the timer rests on the foot, relative to the total amount of allowed time;

wherein the total amount of allowed time is at least a portion of a calendar unit of time, the calendar unit of time being an hour, a morning, an afternoon, an evening, an entire day, a night, a week, a month or a year, and the processor is configured to reset the total amount of allowed time only upon a lapse of the calendar unit of time.

2. The timer of claim 1, wherein the body is octagonal in cross section.

3. The timer of claim 1, wherein the body has an hourglass shape in frontal view.

4. The timer of claim 1, wherein the total amount of allowed time is defined in terms of at least one of the following periods from a group, comprising: a maximum activity period of time for doing activities of a same nature; a minimum interval period of time after lapse of the maximum activity period of time to restart doing activities of a same nature; a minimum pause period within a maximum activity period of time to restart doing activities of a same nature; a maximum activity period of time for doing activities of a same nature per hour, morning, afternoon, evening, entire day or night, week, month or year.

5. The timer of claim 1, wherein the output device comprises an auditory generator to generate a sound signal, such a buzzing sound, a tone, a melody, or even a prerecorded spoken message relating to the monitored lapsed time or the total amount of allowed time.

6. The timer of claim 1, wherein the output device comprises a visual display.

7. The timer of claim 6, wherein the visual display comprises an array of a plurality of light sources, each indicating a proportional part of the set total amount of allowed time, wherein the processor is configured to sequentially extinguish or light up light sources in the array depending on the monitored lapsed time.

8. The timer of claim 7, wherein the visual display comprises a plurality of arrays each comprising light sources having a distinct color per array.

9. The timer of claim 1, further comprising a display screen connected to the processor, wherein the processor is configured to show, on the display screen, at least one information from a group, comprising: the monitored lapsed time, the total amount of allowed time, remaining battery charge, and a user adapted total amount of allowed time for storing in a memory.

10. The timer of claim 9, wherein the processor is configured to, depending on an orientation of the timer, adapt orientation in which the information is shown on the display screen, for the information to be presented upright to a person.

11. The timer of claim 1, further comprising a memory connected to the processor to store the total amount of allowed time.

12. The timer of claim 11, wherein the memory is programmable, and the processor is configured to adapt the total amount of allowed time and store a user adapted total amount of allowed time in the memory.

13. The timer of claim 12, further comprising a wired or wireless communication interface for communications with an external device, wherein the processor is configured to receive the user adapted total amount of allowed time from the external device for storage thereof in the memory, after initial setting or adaptation thereof by a user via a user interface or app being executed on the external device.

14. The timer of claim 1, wherein the processor is configured to execute a program, when loaded thereon, comprising at least one setting from a group at least comprising game time, week time, month time, year time, wait time, interrupt time.

15. The timer of claim 14, wherein the setting is programmable per day, week, month or year.

16. The timer of claim 1, further comprising a wired or wireless communication interface for communications with an external device.

17. The timer of claim 16, wherein the processor is configured to transmit the total amount of allowed time stored in the memory to the external device, upon detection by the communication interface of the establishment of a connection with the external device.

18. The timer of claim 1, wherein at least the exterior surface of the timer is free of input buttons and switches.

19. The timer of claim 1, wherein the sensor comprises at least one device from a group, comprising an accelerometer, an orientation sensor, a GPS module, a gravity sensor.

20. The timer of claim 1, wherein the processor is configured to control the output device to generate a signal indicating that the monitored lapsed time, during which the timer rests on the foot, equals or exceeds the total amount of allowed time.

* * * * *